US005599238A

United States Patent [19]

Roderick

[11] Patent Number: 5,599,238

[45] Date of Patent: Feb. 4, 1997

[54] GOLF PRACTICE DEVICE

[75] Inventor: Anthony G. Roderick, Scituate, R.I.

[73] Assignee: Edward J. Field, Scituate, R.I.

[21] Appl. No.: 578,909

[22] Filed: Dec. 27, 1995

[51] Int. Cl.[6] ..... A63B 69/36

[52] U.S. Cl. ..... 473/147; 473/280

[58] Field of Search ..... 473/143, 144, 473/147, 280, 281

[56] References Cited

U.S. PATENT DOCUMENTS

| | | | |
|---|---|---|---|
| 1,672,395 | 6/1928 | Shinn et al. | 473/147 |
| 2,852,261 | 9/1958 | Meminger | 473/147 |
| 3,051,491 | 8/1962 | Cabot | 473/147 |
| 3,521,887 | 7/1970 | Butkus | 473/147 |

*Primary Examiner*—George J. Marlo
*Attorney, Agent, or Firm*— Salter & Michaelson

[57] ABSTRACT

A golf practice device includes a tethered practice ball which enables the user to practice full-swing golf shots in an area as small as 25–30 feet in length and which when hit properly immediately returns the practice ball toward the user for re-hitting. The golf practice device includes a low resilient urethane foam practice ball, generally of the size of a conventional golf ball, which is attached to an elastic cord. The elastic cord is attached to a swivel element which is, in turn, attached to a non-elastic cord. The non-elastic cord is attached to a bag which is weighted down with a removable weight element, such as sand, pennies or the like. In use, the weighted bag weighs the golf practice device down, the elastic cord functions to return the ball, and the swivel element permits relative rotation of the elastic and non-elastic cords.

19 Claims, 3 Drawing Sheets

GOLF PRACTICE DEVICE

BACKGROUND AND SUMMARY OF THE INVENTION

The instant invention relates to golf practice devices and more particularly to a golf practice device for practicing full swing golf shots with a tethered practice ball which immediately returns toward the user for re-hitting.

Golf practice devices including ball return mechanisms have heretofore been known in the art. However, the shear number and variety of such devices prevents description thereof. While each of the known devices functions satisfactorily for its intended purpose, golfers still seek to develop even more useful and effective devices to improve their play and allow practice in areas not traditionally suited for play of the game.

The instant invention provides a unique golf practice device including a tethered ball which enables the user to practice full swing golf shots in an area as small as 25 feet, and when hit properly immediately returns the ball to the user for re-hitting. The instant golf practice device comprises a practice ball preferably of urethane foam, generally of the size of a conventional golf ball, which is attached to a first end of an elastic cord. The second end of the elastic cord is attached to a swivel element, which is, in turn, attached to one end of a non-elastic cord. The other end of the non-elastic cord is attached to a bag which is weighted with removable weight elements such as sand, pennies, steel washers or similar flat weight. When not in use, the ball and cords can be stored inside the bag. In use, the ball and cords are removed from the interior of the bag and the appropriate weight element is placed inside the bag. The ball can then be hit in a conventional manner wherein the elastic cord functions to spring-return the ball toward the static position, causing the rebound of the ball to cease a safe distance from the user. The weighted bag also may slide along the ground to absorb energy. The ball then rolls toward the user along the ground in a safe manner. The length of the cords permits a maximum of 30 feet extension of the ball from the bag. The swivel element between the elastic and non-elastic cord allows relative rotation of the cords and prevents tangling during flight and return of the ball.

Accordingly, among the objects of the invention are: the provision of a golf practice device which enables a user to practice full-swing golf shots in a relatively small area without a net; the provision of a golf practice device which immediately returns the practice ball for re-hitting; the provision of a golf practice device which is compact in size, easy to use, and inexpensive to manufacture; and the provision of a golf practice device including a tethered ball which gives the user a good indication of the ball flight path before being returned to the user.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
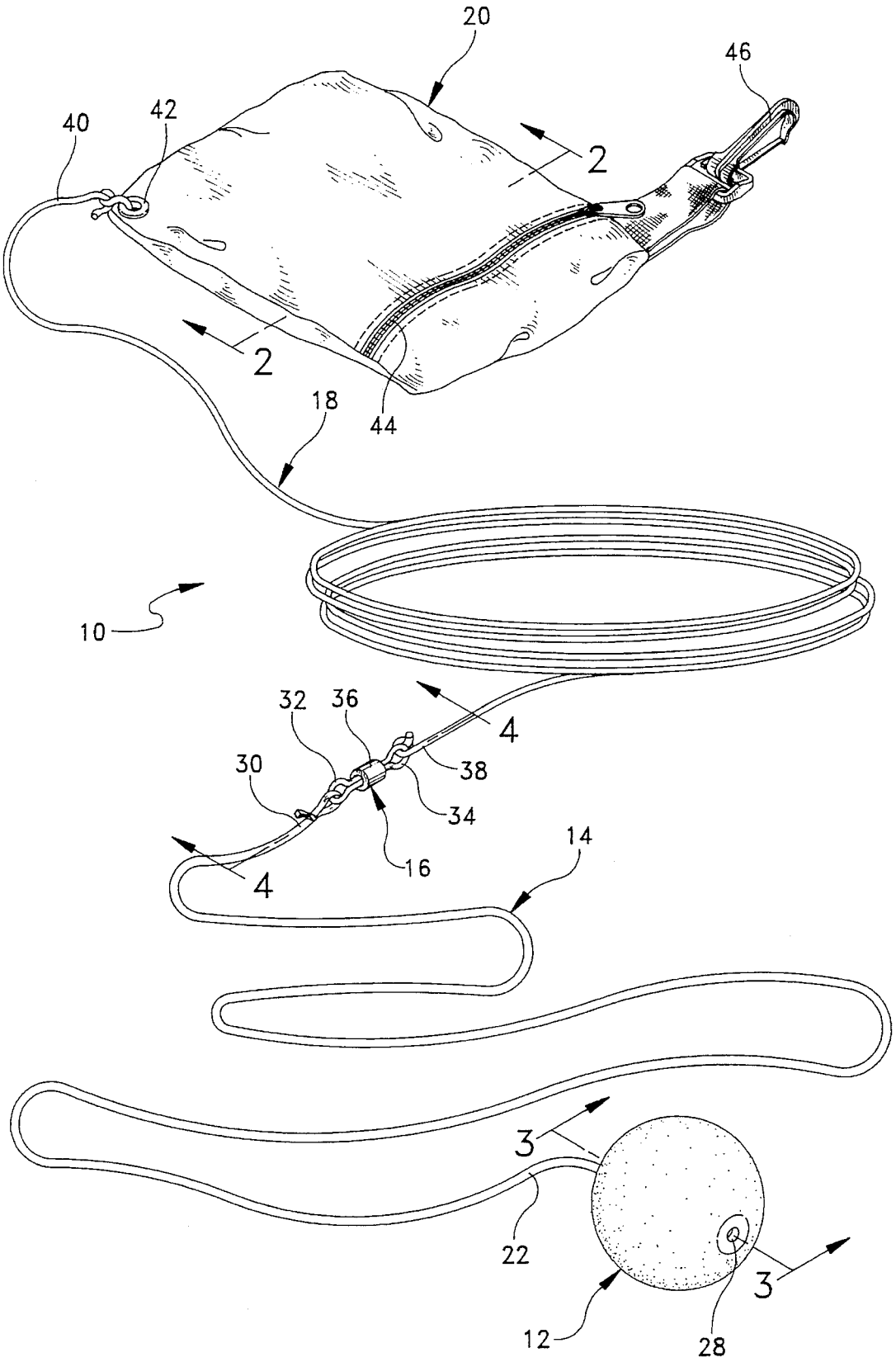
FIG. 1 is a perspective view of the golf practice device of the instant invention.
Figure 2:
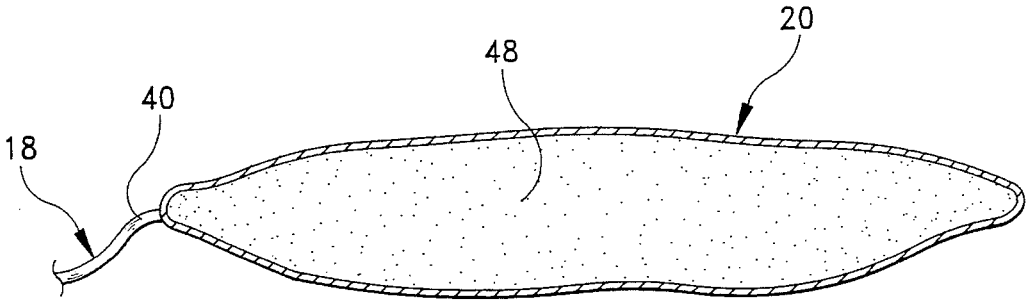
FIG. 2 is a cross-sectional view of the bag taken along line 2—2 of FIG. 1.
Figure 3:
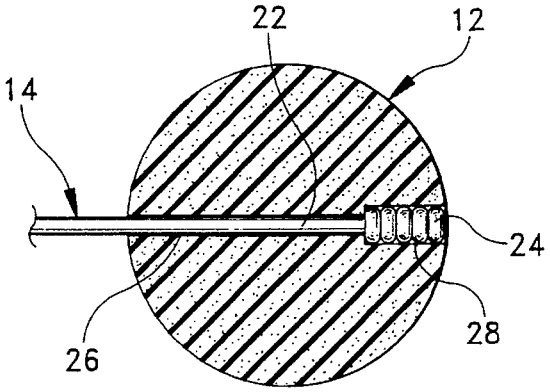
FIG. 3 is a cross-section view of the practice ball taken along line 3—3 of FIG. 1.
Figure 4:
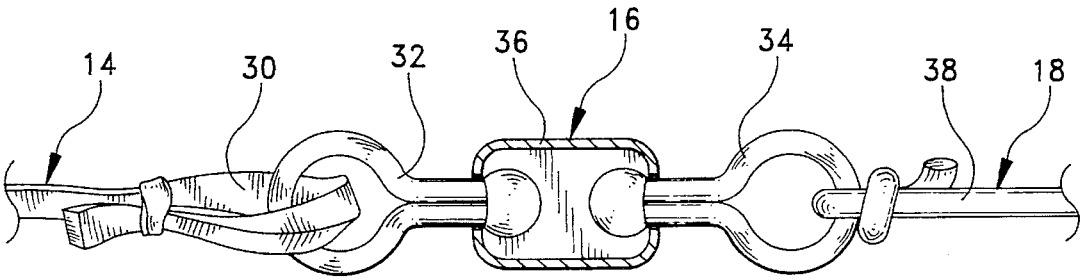
FIG. 4 is a cross-sectional view of the barrel swivel taken along line 4—4 of FIG. 1.
Figure 5:
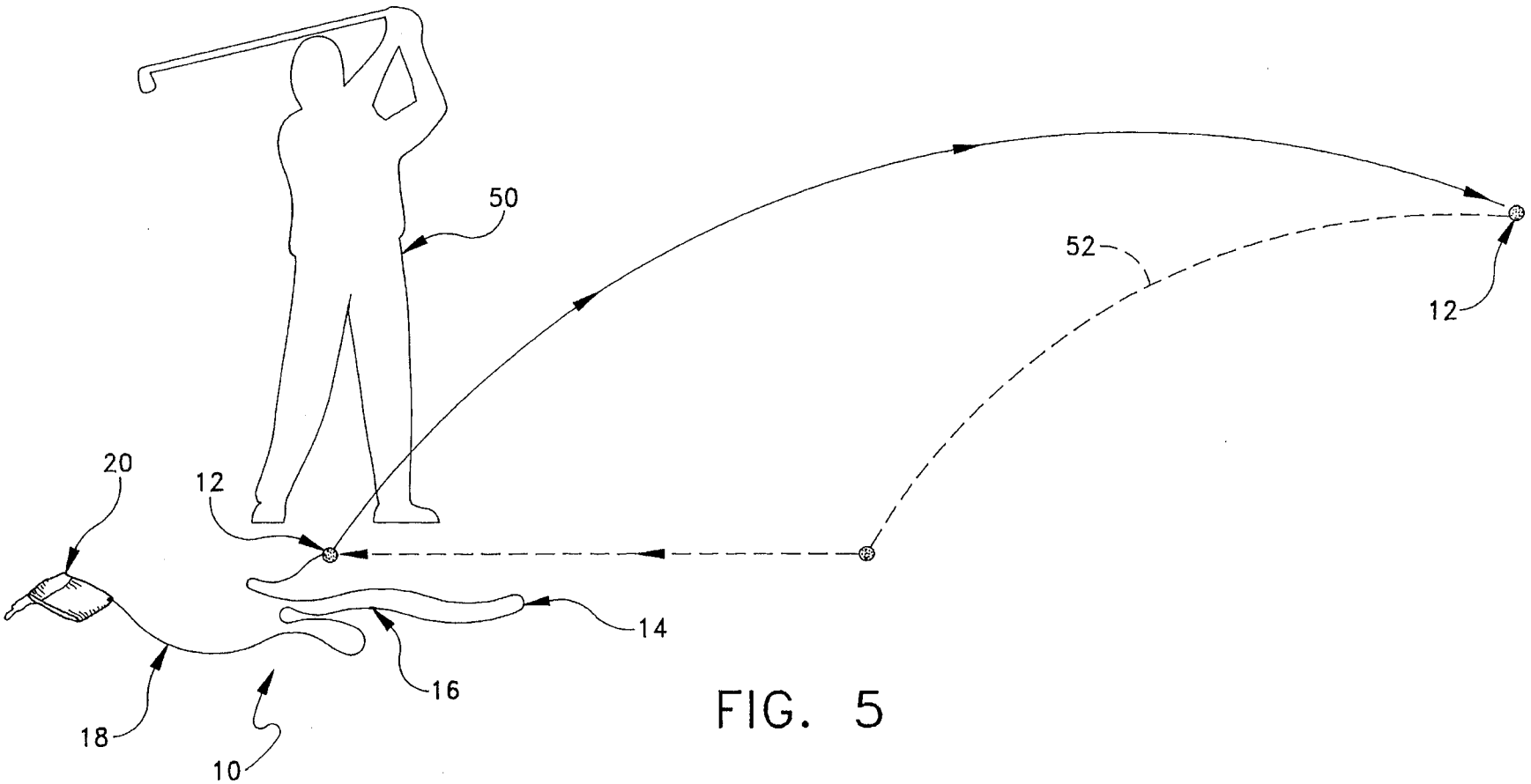
FIG. 5 is another perspective view of the golf practice device illustrating travel of the practice ball during use.

Referring now to the drawings, the golf practice device of the instant invention is illustrated and generally indicated at 10 in FIGS. 1 and 5. As will herein after be more fully described, the instant golf practice device 10 includes a tethered practice ball 12 which enables the user to practice full swing golf shots in an area as small as 25 feet in length.

The golf practice device 10 comprises a practice ball generally indicated at 12, an elastic cord generally indicated at 14, a swivel element generally indicated at 16, a non-elastic cord generally indicated at 18, and a weighted bag generally indicated at 20.

The practice ball 12 is preferably of the size of a conventional golf ball having a similar outer diameter of about 1.7 inches. Further, the practice ball 12 is preferably formed from a low resilient foam-based material so as to substantially absorb the impact of a golf club when the ball 12 is hit. More preferably, the ball 12 is formed from a polyurethane foam. Furthermore, the ball 12 is preferably formed so as to have a weight of between about 25 g and about 30 g. Accordingly, polyurethane foam is ideally suited for the practice ball material. Although polyurethane foam is indicated as the preferred material, other foam materials having similar compression and weight characteristics are also suitable. Also, the practice ball 12 may be molded with dimples on its outer surface to more closely approach the feel of a real golf ball.

The practice ball 12 is secured to a first end 22 of the elastic cord 14 by forming a plurality of knots 24 in the first end 22 of the elastic cord 14 and extending the cord 14 through a diametrical bore 26 formed in the ball 12. The knots 24 are captured in an increased diameter portion 28 of the bore 26 at one end thereof. The elastic cord 14 preferably comprises a natural rubber material and preferably has a length of between about 5 feet to about 13 feet. More preferably, the elastic cord has a length of between about 6 feet and about 9 feet.

The second end 30 of the elastic cord 14 is secured to a first swivel end 32 of the swivel element 16. The swivel element 16 is conventional in the art and comprises first and second hook-eye swivel ends 32 and 34, respectively, rotatably secured in a metallic barrel portion 36.

The second swivel end 34 of the swivel element 16 is secured to a first end 38 of the non-elastic cord 18. The non-elastic cord 18 preferably comprises a braided nylon twine, although other nonelastic twines and ropes are also suitable. Furthermore, the non-elastic cord preferably has a length of between about 5 feet and about 13 feet, and more preferably between about 8 feet and about 11 feet.

The second end 40 of the non-elastic cord 18 is secured to a metallic gromet 42 affixed to a corner of the bag 20. The bag 20 is preferably formed from a canvas, or other rugged material and includes a zipper opening 44 for providing selective access to the interior of the bag 20. Other closure means are also suitable within the scope of the invention. The bag 20 may further include a spring clip 46 for releasably attaching the bag 20 to an object, such as a golf bag, or the user's belt.

In order to weight the bag 20, a removable weight element 48, such as sand, can be placed in the bag when use of the device 10 is desired. Usually about a ½ pound of weight material is used to limit travel of the practice ball 12 when hit. Other suitable weight elements 48 that can be placed in the bag include pennies, steel washers, and other flat objects having a cumulative weight equalling up to about ½ pound and having a volume approximately ½ the volume of the interior of the bag 20. The zipper opening 44 of the bag 20 also allows placement of the cords 14, 18 and practice ball 12 within the bag 20 when not in use to provide compact storage of the device.

In use, a user 50 (FIG. 5) selects an available weight element 48 to place in the bag 20. As stated previously, about a ½ pound of weight is usually sufficient. The user 50 should then place the ball in a normal hitting position in front of the user with the bag 20 in front of the user and slightly to his or her rear (see FIG. 5) with the ball 12 and cords 14, 18 positioned in front of the bag 20 (see also FIG. 5). The user may then proceed to hit the ball 12 in a regular manner. The dead foam construction of the ball 12 absorbs much of the impact of the hit, so that the non-elastic cord 18, and the stretched elastic cord 14 extend out to a distance of about 25 feet. This distance gives the user at least a minimal view of ball flight before it is returned. In this regard, the elastic cord 14 is operable for returning the ball 12 back to the ground in front of the user for re-hitting (see arrows 52 FIG. 5). It is noted that the swivel element 16 enables relative rotation of the elastic cord 14 with respect to the non-elastic cord 18 during flight and return. This relative rotation substantially reduces tangling and bunching of the cords 14, 18 which is normally encountered with elastic cords only. Under normal circumstances, the weighted bag 20 will drag across the ground slightly and travel forward about 1–12 inches.

It can thus be seen that the instant invention provides a unique and effective golf practice device 10 which is compact, easy to use and operable in a relatively small area. The tethered ball 12 and cords 14, 18 can be easily stored in the bag 20 during non-use and then easily removed and set-up for use, and many types of available weight elements 48 are usually readily available for placement into the bag 20. In use, the tethered ball 12, if hit properly immediately returns toward the user for re-hitting, and during ball return gives the user a good indication of actual ball flight. The elastic/non-elastic combination prevents the ball from flying all the way back to the user thus promoting maximum safety to the user. Also, the fact that the weighted bag can slide functions to absorb energy not absorbed by the elastic and the ball. For these reasons, it is believed that the instant golf practice device represents a significant improvement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A golf practice device comprising:

a practice ball;

an elastic cord having a first end anchored to said practice ball;

a swivel element having a first swivel end anchored to a second end of said elastic cord;

a non-elastic cord having a first end anchored to a second swivel end of said swivel element;

weight means anchored to a second end of said non-elastic cord for weighing down said practice ball and substantially preventing said practice ball from flying away when hit, said weight means being movable when said ball is hit to absorb energy imparted to the ball, said swivel element permitting relative rotation of said elastic cord with respect to said non-elastic cord when said practice ball moves through the air.

2. The golf practice device of claim 1, wherein said weight means comprises a bag and a removable weight element disposed in said bag, said bag being anchored to said second end of said non-elastic cord.

3. The golf practice device of claim 2, wherein said bag includes selective closure means for selectively accessing an interior of said bag.

4. The golf practice device of claim 3 further comprising means for releasably attaching said bag to a movable object.

5. The golf practice device of claim 1, wherein said non-elastic cord has a length of between about 5 feet and about 13 feet.

6. The golf practice device of claim 5 wherein said non-elastic cord has a length of between about 7 feet and about 11 feet.

7. The golf practice device of claim 6, wherein said elastic cord has a length of between about 7 feet and about 8 feet.

8. The golf practice device of claim 7, wherein said practice ball has an outer diameter of about 1.7 inches.

9. The golf practice device of claim 8, wherein said practice ball has a weight of between about 20 g and about 40 g.

10. The golf practice device of claim 5, wherein said elastic cord has a length of between about 5 feet and about 11 feet.

11. The golf practice device of claim 10, wherein said elastic cord has a length of between about 6 feet and about 9 feet.

12. The golf practice device of claim 1, wherein said practice ball comprises a low resilient urethane foam material.

13. The golf practice device of claim 12, wherein said practice ball has a weight of between about 20 g and about 40 g.

14. The golf practice device of claim 1, wherein said practice ball has a weight of between about 20 g and about 40 g.

15. A golf practice device comprising:

a urethane foam practice ball having a weight of between about 20 g and about 40 g and an outer diameter of about 1.7 inches;

an elastic cord having a first end fastened to said practice ball;

a swivel element having a first swivel end fastened to a second end of said elastic cord;

a non-elastic cord having a first end fastened to a second swivel end of said swivel element;

a bag fastened to the second end of said non-elastic cord; and a weight element removably received in said bag, said weight element weighing down said practice device and substantially preventing said practice ball from flying away when hit, said bag being movable when said ball is hit to absorb energy imparted to the ball, said swivel element permitting relative rotation of said elastic cord with respect to said non-elastic cord when said practice ball moves through the air.

16. The golf practice device of claim 15, wherein said bag includes selective closure means for selectively accessing an interior portion of said bag.

17. The golf practice device of claim 16, wherein said non-elastic cord has a length of between about 5 feet and about 13 feet, and said elastic cord has a length of between about 5 feet and about 11 feet.

18. The golf practice device of claim 17, wherein said non-elastic cord has a length of between about 9 feet and about 11 feet and said elastic cord has a length of between about 6 feet and about 9 feet.

19. The golf practice device of claim 18 further comprising means for releasably attaching said bag to a movable object.

* * * * *